United States Patent [19]

McCall

[11] Patent Number: 4,475,446

[45] Date of Patent: Oct. 9, 1984

[54] HIGH VOLUME CEILING TYPE AIR DIFFUSER

[75] Inventor: Francis L. McCall, Hacienda Heights, Calif.

[73] Assignee: Specified Ceiling Systems, Alhambra, Calif.

[21] Appl. No.: 577,725

[22] Filed: Feb. 7, 1984

Related U.S. Application Data

[63] Continuation of Ser. No. 363,237, Mar. 29, 1982, abandoned.

[51] Int. Cl.[3] ..... F24F 13/072

[52] U.S. Cl. ..... 98/40 D

[58] Field of Search ..... 98/40 R, 40 C, 40 D, 98/40 V, 40 VM, 40 N, 41 R

[56] References Cited

U.S. PATENT DOCUMENTS

| | | | |
|---|---|---|---|
| 3,308,744 | 3/1967 | Schach | 98/40 D |
| 3,308,745 | 3/1967 | Davies | 98/40 D |
| 3,406,623 | 10/1968 | Lambert | 98/40 D |
| 3,848,799 | 11/1974 | Day | 98/40 D X |

FOREIGN PATENT DOCUMENTS

| | | | |
|---|---|---|---|
| 68034 | 5/1979 | Japan | 98/40 N |

*Primary Examiner*—Harold Joyce

*Attorney, Agent, or Firm*—Christie, Parker & Hale

[57] ABSTRACT

An air diffuser for directing air through an elongated opening in a drop ceiling in a pattern directed along the plane of the ceiling comprises a plenum chamber from which air is directed through a pair of spaced parallel walls forming a duct communicating with the elongated opening. The opening is narrower than the space between the walls so as to form a ledge adjacent the inside of at least one of the walls. A first baffle positioned in the plenum chamber and projecting into the space between the walls forms a throat through which air is directed downwardly against the ledge, the ledge diverting the air out through the opening in a substantially horizontal pattern. A second horizontal baffle within the plenum chamber directs air through a substantially horizontal throat toward the opposite wall and ledge where the air is redirected out the opening in the same horizontal pattern.

6 Claims, 2 Drawing Figures

HIGH VOLUME CEILING TYPE AIR DIFFUSER

CROSS REFERENCE TO RELATED APPLICATIONS:

This is a continuation of application Ser. No. 06/363,237 filed Mar. 29, 1982 now abandanoned.

FIELD OF THE INVENTION

This invention relates to air diffusers for air conditioning systems, and more particularly, to an air diffuser for use in drop ceiling construction.

BACKGROUND OF THE INVENTION

Air diffusers for directing a throw of air from a heating and air conditioning system into a room are well known. When directing air through a drop ceiling, such as commonly used in office buildings, the function of the air diffuser is to distribute the air uniformly and to circulate the air in the room without producing uncomfortable drafts. It is therefore desirable to provide a ceiling air diffuser which directs the air initially in a substantially horizontal pattern extending along the underside of the ceiling toward one of the walls of the office, thus setting up a pattern of air circulation around the margins of the room.

An example of a linear air diffuser for a drop ceiling is shown in U.S. Pat. No. 3,406,623. In this type of linear air diffuser, a plenum chamber is positioned above the drop ceiling and air is discharged from the plenum chamber through a restricted throat formed by a pair of closely spaced, vertical walls. Air is discharged from this throat against a horizontal ledge located along the edge of an opening in the plane of the ceiling. The ledge directs the air through the opening in a direction in which the discharged air tends to flow horizontally along the surface of the ceiling. The amount of air discharged through the opening in the ceiling is limited by the width of the throat which is substantially narrower than the ceiling opening.

SUMMARY OF THE INVENTION

The present invention is directed to a linear air diffuser for drop ceiling construction in which air is directed from a plenum chamber into the room through an elongated slot in the ceiling. The present invention provides an arrangement in which the volume of air passing into the room through the slot is substantially increased while still maintaining the desired substantially horizontal throw pattern of the air entering the room. The air diffuser can be either used as a perimeter device adjacent one wall of the room or as a bidirectional device which can be adjusted to direct air in either direction away from the slot.

This is accomplished, in brief, by providing a plenum chamber having a duct opening into the bottom of the plenum chamber and communicating with the slot in the ceiling, the duct having a pair of spaced parallel vertical walls extending the length of the slot terminating at their lower edges in a lip or ledge projecting inwardly towards the opposing wall of the duct. A first baffle forms a throat with one of the walls of the duct for directing air from the plenum chamber downwardly against the ledge, the ledge deflecting the air into the room in a substantially horizontal pattern extending away from the ledge. A second baffle positioned in the chamber forms a horizontal throat with the bottom of the plenum chamber for directing air horizontally against the backside of the first baffle and downwardly against the same ledge from which the air is directed out of the opening in the same horizontal throw pattern. Thus two separate air passages are provided from the plenum chamber substantially increasing the volume of air which is directed from the plenum chamber out the ceiling slot in a horizontal pattern.

DESCRIPTION OF THE DRAWINGS

For a better understanding of the invention, reference should be made to the accompanying drawings, wherein.

DETAILED DESCRIPTION

Figure 1:
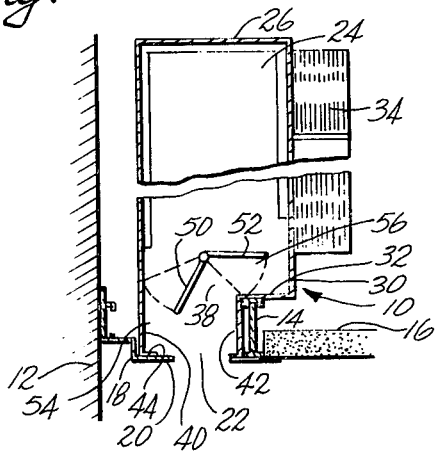
FIG. 1 is a cross-sectional view of one embodiment of the present invention.

Referring to FIG. 1 in detail, there is shown an air diffuser which incorporates the features of the present invention but is primarily directed to a perimeter type air diffuser having a single horizontal throw pattern. The air diffuser, indicated generally at 10, is normally positioned adjacent a perimeter wall 12 of the room. The air diffuser is positioned above a drop ceiling which includes a conventional T-runner or frame member 14 spaced from the wall and normally supported by wire hangers (not shown). An acoustic ceiling tile 16 is supported on the T-runner to form the drop ceiling. A metal angle frame member 18 extending from the wall 12 terminates in a horizontal portion 20 which lies in the same horizontal plane with the bottom of the T-runner 14 and is spaced therefrom to form an elongated opening or slot 22.

The air diffuser includes a plenum chamber 24 which is substantially rectangular in cross-section and having a top wall 26, side walls 28 and 30 and a bottom wall 32. An input duct 34 opens into the plenum chamber through the side wall 30 for directing a supply of air into the plenum chamber.

The bottom wall 32 of the plenum chamber has an opening 38 through which air can pass downwardly through a duct formed of spaced parallel walls 40 and 42. The wall 40 of the duct may form a continuation of the wall 26 of the plenum chamber. The lower edge of the wall 40 terminates in an inwardly turned horizontal ledge 44 which rests on the top of the horizontal portion 20 of the frame member 18. The bottom wall 32 of the plenum chamber preferably rests on top of the T-runner 14 with the duct wall 42 terminating at the top of the runner 14.

A pair of baffles 50 and 52 are located inside the plenum chamber, the baffles preferably being joined to each other along one longitudinal edge, with the planes of the two baffles extending at an obtuse angle relative to each other. The baffles are preferably pivotally supported between the end walls of the plenum chamber so as to rotate about the axis extending along the line of intersection between the two baffles.

In the position shown in FIG 1, the baffle 52 is substantially horizontal and is spaced above the bottom wall 32 of the plenum chamber while the baffle 50 extends downwardly toward the intersection between the wall 40 and the ledge 44. Thus the baffle 50 forms an elongated throat 54 between the lower edge of the baffle and the adjacent side wall 40 through which air is directed downwardly from the plenum chamber toward the ledge 44. The baffle 52 forms a substantially horizontal throat 56 through which air is directed from the plenum chamber in a direction toward the back side of the baffle 50 and then downwardly towards the ledge 44. Air passing through the two throats 54 and 56 merge at the ledge 44 and are deflected outwardly through the opening 22 in a direction substantially horizontal to the ceiling tiles 16. Thus a common horizontal throw pattern is provided for air passing from the plenum chamber through the two throats out through the opening 22. By providing the two air passages from the plenum chamber, it has been found that the air capacity of the air diffuser is increased by as much as 70 percent without any adverse effect on the throw pattern of the air entering the room. By rotating the two baffles to the dotted position shown in FIG. 1, the air can be substantially shut off. The amount of air, of course, can be regulated by adjusting the baffles to an intermediate position, or a vertical throw pattern can be achieved by rotating the baffle 50 into a vertical position.

Figure 2:
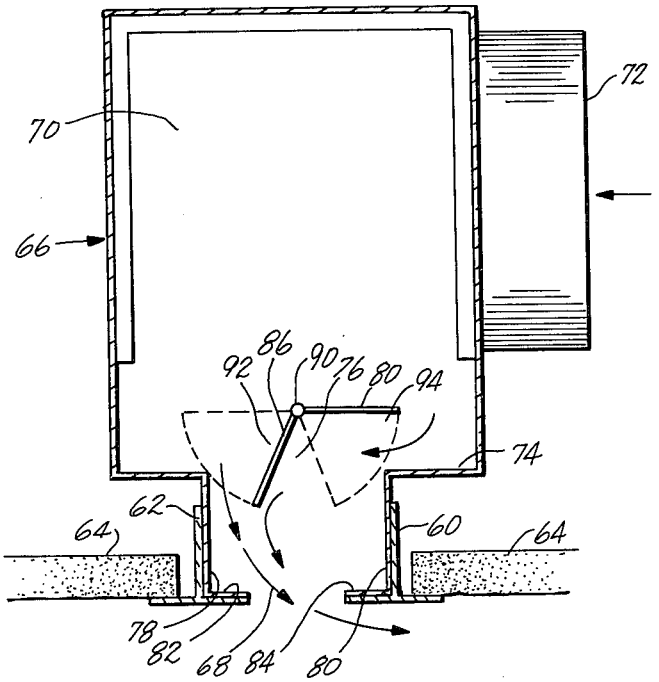
FIG. 2 is a cross-sectional view of an alternative embodiment of the present invention.

Referring to the embodiment shown in FIG. 2, there is shown a non-perimeter system in which the throw pattern may be directed either to the right or to the left as it emerges through an elongated opening or slot in a drop ceiling. The elongated opening 68 in the drop ceiling is provided by a pair of spaced T-runners 60 and 62 which normally are used to support ceiling tiles 64 in a conventional drop ceiling construction. An air diffuser, indicated generally at 66, directs air through the slot 68. The air diffuser, which incorporates the features of the present invention, includes a plenum chamber 70 which receives air through an input duct 72. The bottom wall 74 of the plenum chamber has a centrally located, elongated opening 76 which allows air to be released from the plenum chamber through a duct having vertical side walls 78 and 80. The side walls terminate at their lower edges in a horizontal ledge, indicated respectively at 82 and 84. The horizontal ledges rest on top of the T-runners for supporting the air diffuser on top of the drop ceiling.

As in the air diffuser shown in FIG. 1, a pair of baffles 86 and 88 are positioned in the plenum chamber adjacent the opening 76. The two baffles 86 and 88 are joined at an obtuse angle along one edge which also defines the axis 90 about which the baffles are rotated as a unit. With the baffles in the position shown in FIG. 2, air is directed through a first throat 92 formed between the side wall 78 of the duct and the baffle 86. A second throat 94 is formed between the baffle 88 and the bottom wall 74 of the plenum chamber. Air passing through these two elongated throats is directed toward the horizontal ledge 82 and then is diverted to the right in a substantially horizontal throw pattern along the surface of the ceiling. By rotating the baffles to the dotted line position shown in FIG. 2, the throw pattern is reversed, the air being deflected off the ledge 84 and in a substantial horizontal pattern to the left through the opening 68, as viewed in FIG. 2. At various intermediate positions, the size of the throats can be constricted or completely shut off to adjust the volume of air, as well as the throw pattern of the air entering the room.

As in the arrangement of FIG. 1, the air diffuser of the present invention by providing two throats through which air is released from the plenum chamber, substantially increases the air capacity of the diffuser while still maintaining a substantial horizontal throw pattern for the air released into the room. By the same token, the same air output can be achieved with a lower pressure in the plenum chamber and hence with a lower capacity, lower energy-consuming air conditioning system for delivering air to the air diffuser.

What is claimed is:

1. An air diffuser for directing air through a single elongated opening in a drop ceiling in a pattern directed along the plane of the ceiling, comprising:

a plenum chamber positioned above the plane of the ceiling having a bottom wall extending parallel to the plane of the ceiling and having side walls extending upwardly from the bottom wall, a pair of spaced parallel vertical walls extending downwardly from the bottom wall of the plenum chamber above the elongated opening in the ceiling, said parallel walls extending parallel to the length of the elongated opening and being spaced apart a distance greater than the width of the opening, the bottom wall of the plenum chamber being open between the parallel walls for passing air from the plenum chamber into the space between the parallel walls out the opening in the ceiling, the lower edge of at least a first one of the parallel walls terminating in a ledge extending perpendicularly toward the opposite parallel wall, a first baffle positioned in the plenum chamber and extending into the space between the parallel walls toward the ledge, the first baffle forming a first throat with said first one of the parallel walls for discharging air in a first stream directed downwardly from the plenum chamber at said ledge, and a second baffle positioned in the plenum chamber above the opening between the parallel walls, the first and second baffles intersecting within the plenum chamber the second baffle forming a second throat with the bottom wall of the plenum chamber for discharging air from the plenum chamber in a second stream directed at said first baffle and associated ledge.

2. Apparatus of claim 1 wherein the baffles are joined along said axis and rotatable as a unit about said axis.

3. Apparatus of claim 2 wherein the baffles when rotated in one direction about said axis reduce the size of both of said respective throats to reduce the flow of air in both of said air discharge paths.

4. Apparatus of claim 2 wherein both of said parallel walls terminate in a ledge on either side of the opening in the ceiling, and the bottom of the plenum chamber extends outwardly on either side of said parallel walls, the baffles being rotatable to move the first baffle up to a position completely within the plenum chamber and to move the second baffle into the space between said parallel walls.

5. Apparatus of claim 2 wherein said first wall terminating in said ledge is an extension of a side wall of the plenum chamber.

6. An air diffuser comprising:

a plenum chamber for storing a volume of air under increased pressure, an outlet duct opening into the plenum chamber through one wall of the plenum chamber, the duct having spaced parallel side walls extending perpendicular to said one wall of the plenum chamber at one end of the duct and terminating in a ledge projecting into the duct at the other end of the duct from one of said parallel side walls, baffle means in the plenum chamber forming first and second throats through which air passes from the plenum chamber into the duct, the baffle means including a first baffle forming a first throat with said one of the duct side walls and providing a first air passage directing air from the plenum chamber at the ledge along said one of the side walls, and a second baffle in the plenum chamber spaced from and forming a second throat with said one wall of the plenum chamber, the second baffle and the first baffle intersecting in the plenum chamber at an angle to each other, the second baffle providing a second air passage directing air from the plenum chamber toward the opposite side of the first baffle from said first air passage, the first baffle deflecting the air in the second air passage at the same ledge.

* * * * *